US005452997A

United States Patent [19]

Hekman et al.

[11] Patent Number: 5,452,997

[45] Date of Patent: Sep. 26, 1995

[54] ROTARY DEVICE WITH THERMALLY COMPENSATED SEAL

[75] Inventors: Frederick A. Hekman, Grand Rapids; Edward W. Hekman, Alto, both of Mich.

[73] Assignee: Autocam Corporation, Kentwood, Mich.

[21] Appl. No.: 181,381

[22] Filed: Jan. 13, 1994

[51] Int. Cl.[6] ..... F01C 19/08

[52] U.S. Cl. ..... 418/144; 418/1; 418/179; 277/26

[58] Field of Search ..... 418/1, 144, 261, 418/83, 179; 277/96.2, 26

[56] References Cited

U.S. PATENT DOCUMENTS

| | | | |
|---|---|---|---|
| 3,464,362 | 9/1969 | Ross | 418/144 |
| 3,612,545 | 10/1971 | Storms | 277/26 |
| 4,449,422 | 5/1984 | Fuehrer et al. | 277/26 |
| 4,560,332 | 12/1985 | Yokoyama et al. | 418/179 |
| 4,923,377 | 5/1990 | Cavalleri | 418/144 |
| 5,169,298 | 12/1992 | Hekman et al. . | |
| 5,181,843 | 1/1993 | Hekman et al. . | |

FOREIGN PATENT DOCUMENTS

| | | | |
|---|---|---|---|
| 3821162 | 8/1989 | Germany | 418/144 |
| 0215889 | 9/1988 | Japan | 418/179 |

OTHER PUBLICATIONS

Exhibit A is a photocopy of Devcon package for "Plastic Steel Putty (A)".

Exhibit B is a photocopy of Devcon package for "Putty Hardener 0200".

Exhibit C is a photocopy of Devcon product data bulletin for "Plastic Steel Putty (A)".

*Primary Examiner*—Richard A. Bertsch
*Assistant Examiner*—Charles G. Freay
*Attorney, Agent, or Firm*—Price, Heneveld, Cooper, DeWitt & Litton

[57] ABSTRACT

A rotary device in which a seal is formed between the rotor and the stator end members by a sealing material having a coefficient of thermal expansion which is greater than that of the material of the end member in which said sealing material is located. When exposed to normal service temperatures, the sealing material bulges out of the parent material to fill in the gap between the end member and the rotor. The sealing material is wearable such that as it expands into engagement with the rotor, it will eventually wear until it no longer contacts the mating surface and a small gap or "minimal clearance" exists.

23 Claims, 3 Drawing Sheets

ROTARY DEVICE WITH THERMALLY COMPENSATED SEAL

BACKGROUND OF THE INVENTION

The present invention relates to rotary devices such as pumps, compressors and the like and more particularly to a unique thermally compensated seal which increases the efficiency of such devices.

The efficiency of rotary devices utilized for pumping a fluid or compressing a vapor largely depends upon the internal tolerances of the components comprising the device. A loosely-toleranced rotary pump or compressor may have a relatively poor fit between internal components and may therefore exhibit poor efficiency, with relatively high leakage occurring within the device from regions of high pressure to regions of lower pressure. The traditional approach to this situation is to decrease the amount of clearance on these critical interfaces. This approach in turn dictates tighter tolerances for the individual components and requires more expensive manufacturing processes. For example, it may be possible to generate a 1.000"±0.001" dimension by machining on a lathe, but a 1.0000"±0.0002" dimension will require secondary machining operations such as grinding or lapping. Thus, it has traditionally been relatively expensive to create a compressor or pump with minimal clearances and high efficiency.

An alternate solution to the leakage problem uses an elastomeric seal to close the gap. O-rings or lip type seals can be used in many instances to seal very effectively. This approach is widely used to seal against rotating shafts, for instance. Where there is relative motion against an interrupted surface, however, elastomeric seals will suffer accelerated wear and premature failure. For this reason traditional elastomeric seals are not a good sealing means for the gap between time rotor and covers of a rotary vane compressor or motor.

SUMMARY OF THE INVENTION

The present invention uses an adaptive seal design to produce a tight-fitting assembly in service, even though initial clearances may be relatively large. This is accomplished by using a wearable, thermally compensated sealing material which is recessed into one of the surfaces of the critical interface. This material has, by design, a higher coefficient of thermal expansion than the parent material. When exposed to normal service temperatures this material will bulge out of the parent material to fill the gap. When the material fills the gap completely, it will contact the mating surface and begin to wear away. Further expansion will result in additional wear, until eventually the sealing material no longer contacts the mating surface and a small gap exists. This is the desired "minimal clearance" condition. In this way tight, highly efficient compressors or motors can be produced with lower manufacturing costs than would be possible using traditional sealing methods.

DESCRIPTION OF THE PREFERRED EMBODIMENT

The present invention relating to a thermally compensated seal is envisaged to be applicable in a multitude of rotary devices comprising a rotor with projecting vanes mounted in a stator housing having end walls or covers against which the rotor and vanes rotate. However, according to the preferred embodiment and for purposes of describing the invention, it is disclosed herein as incorporated in a constrained rotary vane compressor. It is noted that additional details on the exemplary constrained rotary vane compressor described below can be obtained from publicly available U.S. Pat. No. 5,181,843 to Hekman et al., issued Jan. 26, 1993, entitled "INTERNALLY CONSTRAINED VANE COMPRESSOR".

Figure 1:
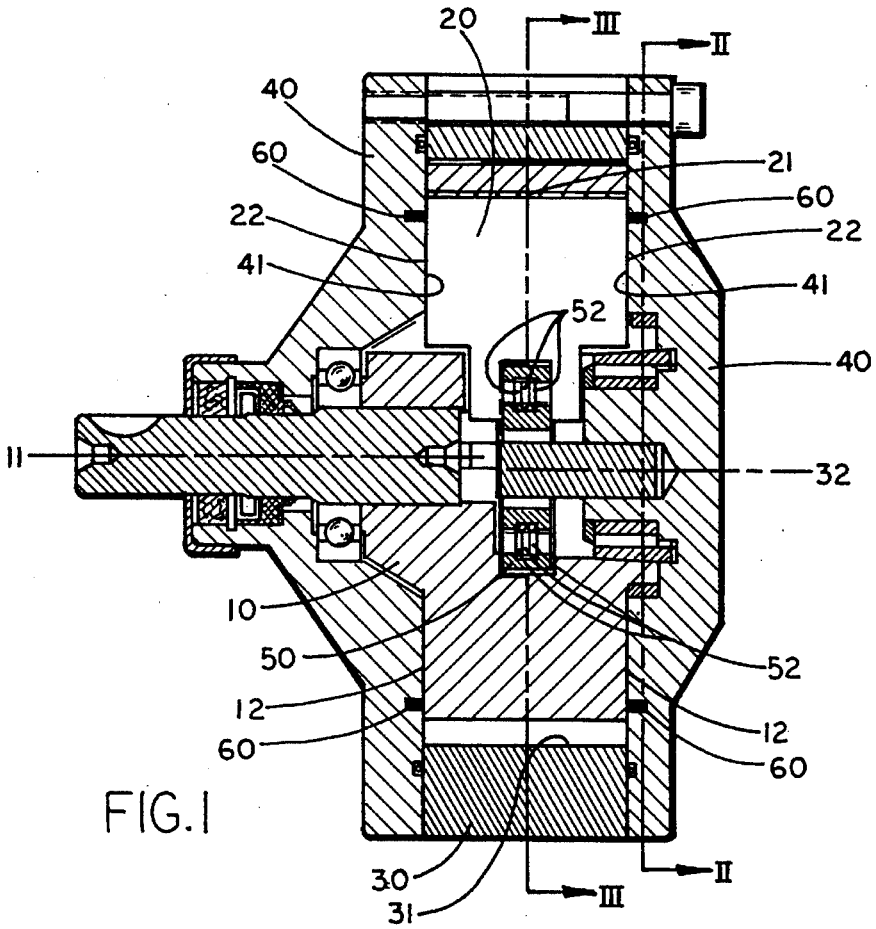
FIG. 1 is a cross section taken along plane I—I of FIG. 3 of a typical constrained rotary vane compressor utilizing a sealing means of the present invention.
Figure 2:
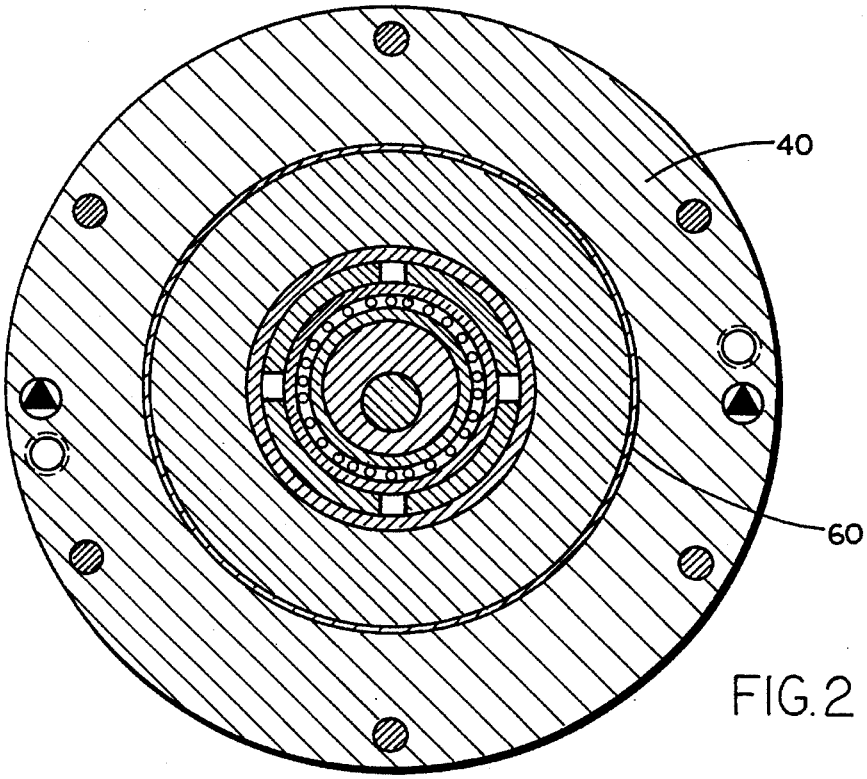
FIG. 2 is a sectional view of a typical constrained rotary vane compressor taken along plane II—II of FIG. 1, illustrating the sealing means of the present invention.
Figure 4:
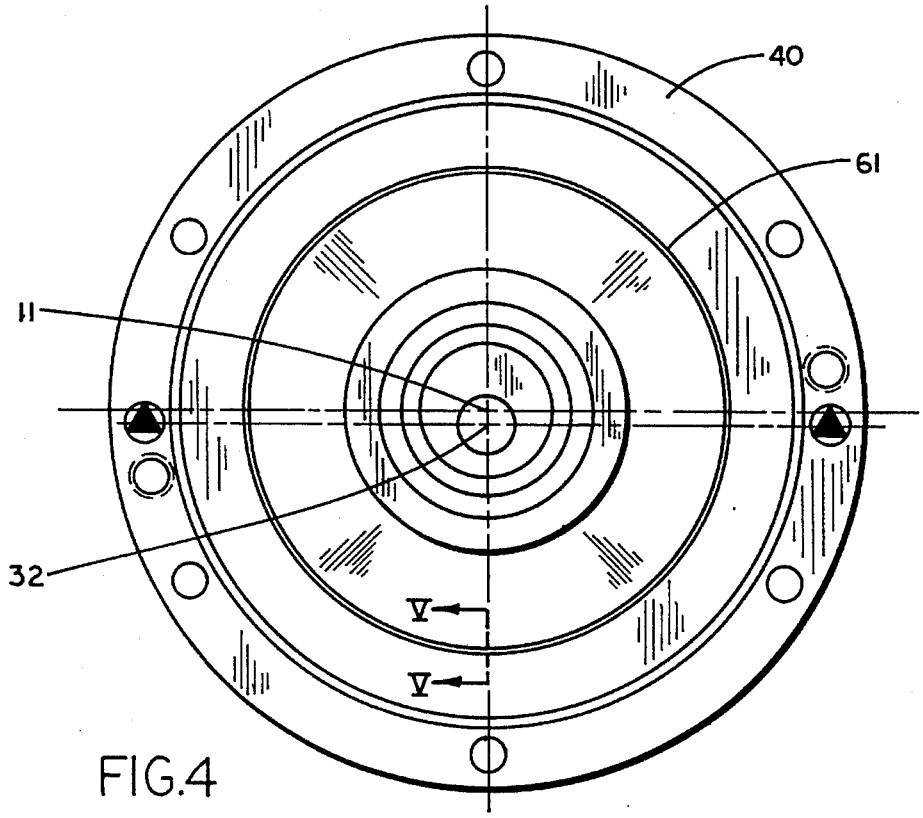
FIG. 4 is a side elevational view of the interior surface of a stator end cap.
Figure 3:
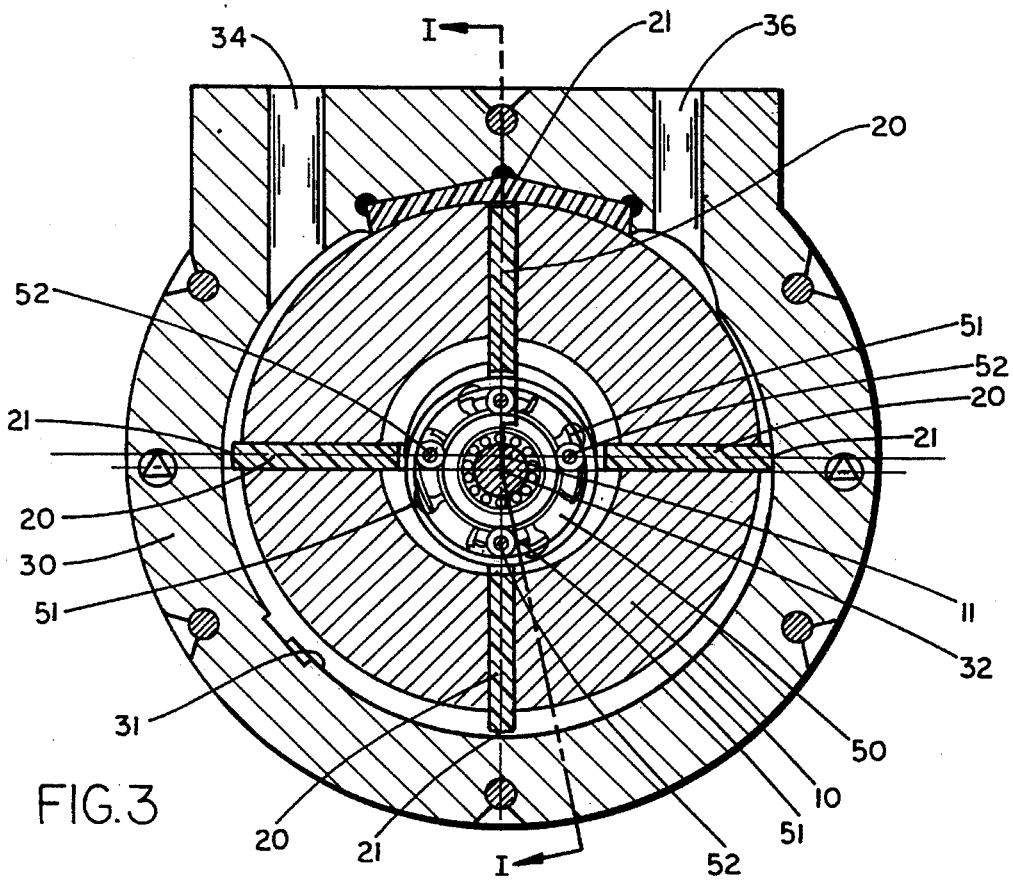
FIG. 3 is a sectional view of a typical constrained rotary vane compressor taken along plane III—III of FIG. 1.

In the preferred embodiment illustrated in FIGS. 1, 2 and 3, a constrained rotary vane-type compressor used to compress a refrigerant vapor (herein referred to as "vapor") has a central rotary member or rotor 10 having a plurality of vanes 20 slidably extending radially outward from rotor 10, residing within a stator 30. A shaft extending through the rotor 10 provides for rotation and mounting of the rotor 10 within stator 30. As shown in FIG. 3, stator 30 generally provides an inlet port 34 and an outlet port 36. Stator 30 (FIG. 1) has end members or end caps 40 formed or attached at both ends. The axis of rotation 11 of rotor 10 is offset from, but parallel to, the axial centerline 32 of stator 30 so as to form vaned compartments of varying volume throughout the cycle of rotation.

The distal vane tips 21 (FIG. 3) of vanes 20 "engage" the interior surface 31 of stator 30, thereby forming a seal between vane compartments along the length of tips 21 throughout the region of compression. Otherwise, vapor in a particular compartment undergoing compression may escape to other regions within the stator, thereby lowering the overall efficiency of the compressor. By "engage" it is meant that the distal vane tips come into very near proximity to the surface of the stator interior. In the preferred embodiment, the gap between the vane tip and the interior surface of the stator is in the range of 0.025 to 0.127 mm, (0.001 to 0.005 inches). To assist such engagement, the vanes may be further guided by tracks 51 in carrier 50. Thus, each vane 20 is equipped with at least one roller 52 which runs in tracks 51. Track 51 provides a cam surface for roller 52 contacting it, such that as the rollers progress within a track, vanes 20 are guided as they rotate within the interior of stator 30.

A major source of leakage between regions of differing pressure within the interior of rotary compressors or motors is between vane lateral edges 22, rotor sides 12, and interior surface 41 of end caps 40 (FIG. 1). In constrained rotary vane compressors, this distance is approximately 0.0025 mm (0.001 inch). The present invention is directed toward a sealing means 60 configured in one or both end caps 40 which provides a barrier to the flow of vapor within the compressor from regions of high pressure to regions of lower pressure.

Figure 5:
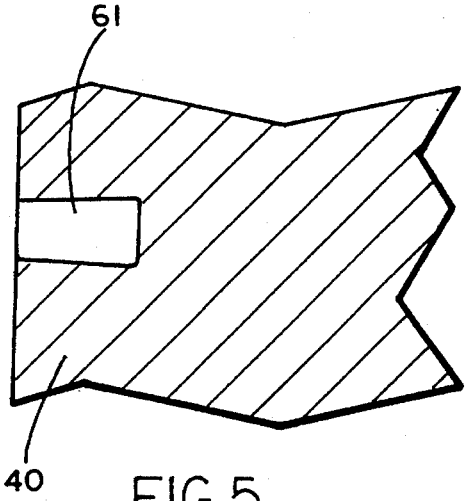
FIG. 5 is a sectional view of a sealing groove of the sealing means of the present invention taken along plane V—V of FIG. 4.

The sealing means 60 is illustrated generally in FIGS. 1 and 2 and in detail in FIGS. 5–8. In the preferred embodiment, the sealing means 60 comprises a seal groove 61 formed on the inward face or interior surface 41 of one or both end caps 40, and a seal 62 retained in seal groove 61. The seal groove 61 is preferably generally circular, having its center point common with the axis of rotation 11 of rotor 10. The cross-sectional geometry of groove 61 may take a variety of forms, including a rectangle, dovetail, V-shape and variations thereof. Typical dimensions for groove 61 having a generally rectangular cross section are approximately 1.5 mm in width and 3 mm in depth (0.060×0.120 inches). The preferred shape of the cross section of seal groove 61 is a dovetail shape as shown in FIG. 5, in which the base of the groove has a greater width dimension than the groove opening. Such geometry assists in retaining seal 62 when seal material is deposited and subsequently cured within groove 61.

The choice of material for seal 62 depends upon the expected operating conditions of the compressor, the materials of construction of the compressor, particularly those of end caps 40, rotor 10 and vanes 20, the thermal expansion coefficients of these members, and related concerns such as cost and impact upon assembly operations. For the thermally compensated seal to function properly, the material used for seal 62 must have a coefficient of thermal expansion which is greater than the coefficient of thermal expansion for the end caps 40.

Specifically, sealing material 62 must have a high enough coefficient of expansion, and must be deep enough in sealing groove 61 that as the compressor or motor comes up to its normal operating temperature, the seal material 62 will expand outwardly past the inside face of end cap 40, a distance sufficient to fill the maximum possible clearance between the rotor 10 and end cap 40, given the manufacturing tolerances accepted. The seal material 62 must adhere tenaciously to the seal groove 61 and must be chemically stable in the presence of refrigerant and oil. In addition, the material must wear away when it comes into contact with the mating surface 12 of the rotor, rather than tear away in chunks, and it must do so without damaging the mating surface 12 of the rotor or stopping rotation of the rotor. The present inventors have investigated the use of an epoxy material for seal 62, and the preferred embodiment uses a steel-filled epoxy material.

It should be noted that a wide range of coefficients of thermal expansion can be achieved by blending metal filler into the epoxy. Steel has a coefficient of thermal expansion of $6.7\times10^{-6}$ in./in. °F. and unblended epoxy may have a coefficient of thermal expansion 30 times as great ($210\times10^{-6}$ in./in. °F.).

A more preferred range is for the sealing material to have a coefficient of thermal expansion of from about 2 to about 12 times that of the material of which the rotor end cover 40 is made. The metal-filled epoxy, used in the preferred embodiment, however, has a coefficient of thermal expansion of $48\times10^{-6}$ in./in. °F. Various grades with more or less steel filler could be made with coefficients of thermal expansion that would be lower (closer to $6.7\times10^{-6}$ in./in. °F.) or higher than the grade used. In this way the designer can tailor not only the physical dimensions of the seal but also the sensitivity of the material to temperature changes so as to achieve a seal with the desired expansion.

The preferred choice of material for seal 62 is a metal-filled epoxy having a coefficient of thermal expansion of $48\times10^{-6}$ in./in. °F. Such material is available from Devcon Corporation of Danvers, Mass. under the designation "Plastic Steel Putty (A)". This material is cured by the addition of a second component, a hardener also available from Devcon under the designation "Putty Hardener 0200". The Devcon Plastic Steel Putty (A) is a steel filled, amine based, room temperature curing epoxy. Upon mixing with the hardener, the components form a bisphenyl A diglycidl ether resin system. The above noted Devcon system utilizes steel as the choice of material for the metallic particles dispersed in the epoxy system. The Devcon system has excellence adhesive properties and excellent chemical resistance to a variety of hydrocarbons, organic solvents and water. Devcon exhibits the following properties: cured hardness (Shore D ASTM 2240) of 85D, flexural strength (ASTM D 790) of 5,600 psi, adhesive tensile shear strength (ASTM D 1002) of 2,800 psi, cure shrinkage of (ASTM D 2566) 0.0006 in./in., and a temperature resistance (dry) of 250° F. It is envisaged that other materials or combinations may be utilized for seal material 62.

Figure 6:
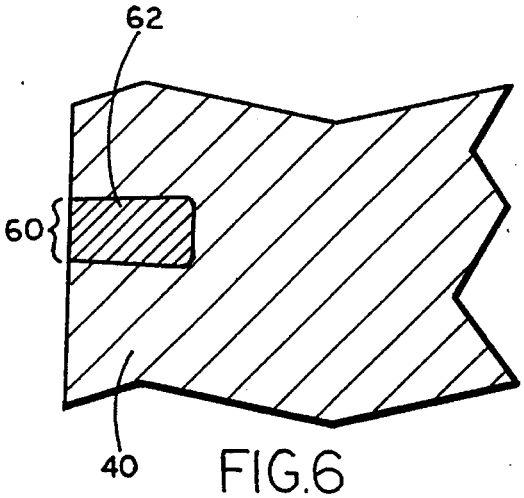
FIG. 6 is a sectional view of the sealing means of the present invention having a sealing material deposited in the sealing groove, taken along plane V—V of FIG. 4.
Figure 7:
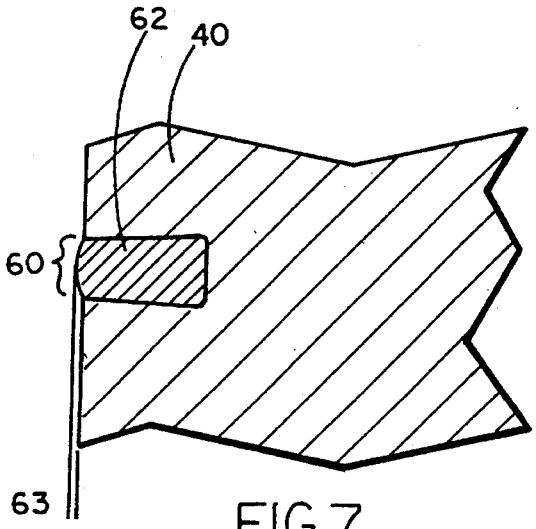
FIG. 7 is a sectional view of the sealing means of the present invention at an elevated temperature before a wear-in period, taken along plane V—V of FIG. 4.
Figure 8:
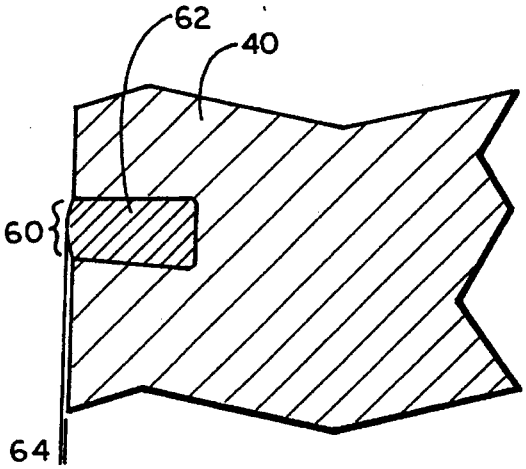
FIG. 8 is a sectional view of the sealing means of the present invention at an elevated temperature after the wear-in period, taken along plane V—V of FIG. 4.

The process whereby the seal is created and its principle of operation can be better understood by referring to FIGS. 5–8. FIG. 5 is an enlarged sectional view of one end cap 40, showing the cross section of the machined groove into which the seal material will be deposited. FIG. 6 shows the groove filled with material. In the preferred embodiment the filler material, a two-part metal-filled epoxy, is applied to the groove and allowed to harden. When the epoxy is fully cured the inner surface 41 of the end cap is remachined by turning, milling, or lapping to ensure that at room temperature the exposed surface of seal material 62 is flush with the adjacent inner surface 41 of end cap 40. FIG. 7 shows what would happen to the seal material if it were heated to normal service temperatures (e.g. 200° F.) in the free state. Note that the seal material 62 bulges out of the plane defined by inner surface 41 of end cap 40. In the assembled state this type of expansion would decrease the clearance between the end cap 40 and the rotor 10, eventually leading to physical contact between the seal material 62 and the rotor side 12.

In practice, this physical contact due to thermal expansion of the seal material will result in abrasive wear and erosion of seal material 62. Further expansion will lead to further wearing away of the seal, until the seal has worn in to the condition shown in FIG. 8. The seal material 62 in this condition will protrude a distance 64 out from the inner surface 41 of end cap 40. As worn in, the seal will perfectly fill the gap, i.e. this distance 64 will be slightly less than the assembled clearance between the end cap 40 and the rotor side 12.

The key advantage to this sealing method is that it is adaptive. The final protrusion distance 64 may end up to be 0.0001" or it may be 0.003", depending on the fit of the individual rotor 20, stator 30 and covers 40 involved. Within a certain range, it does not matter what the initial clearance is. As the assembly heats up and wears away in service, the seal will wear to the proper height. By design the seal will adapt to a wide range of clearance conditions to finally yield a close-fitting assembly.

Another advantage of this sealing method is that it is thermally compensated. As operating temperatures increase, the seal closes and improves its performance. Thus maximum sealing performance is achieved when temperatures reach their peak, precisely when minimum leakage is most necessary.

It is also possible to produce seal 62 by forming an amount of seal material in a particular shape and of a certain size, external from seal groove 61 or end cap 40, or other like substrate. That is, the sealing material could be appropriately fashioned and partially or entirely cured or hardened if necessary, and then placed in seal groove 61. The shaped seal material could then be affixed if necessary to the underlying substrate or groove by a variety of methods known to those skilled in the art.

The present inventors have envisaged numerous variations of the preferred embodiment for the sealing means described herein. Such variations include increasing the width dimension of seal groove 61, utilizing multiple sealing means 60 in a rotary compressor, and utilizing other materials besides a metal-filled epoxy for seal 62. Moreover, the present invention is not limited to constrained vane rotary compressors. The sealing means described herein would be equally applicable to a multitude of other types of rotary devices such as nonconstrained vane compressors, pumps, hydraulic motors, rotory activators, air motors and the like.

Of course, it is understood that the foregoing is merely a preferred embodiment of the invention and that various changes and alterations can be made without departing from the spirit and broader aspects thereof as set forth in the appended claims, which are to be interpreted in accordance with the principles of patent law, including the Doctrine of Equivalents.

The embodiments of the invention in which an exclusive property or privilege is claimed are defined as follows:

1. A rotary device comprising:

a rotor rotatably mounted within a stator, said stator including end covers on either side of said rotor, at least one of the end covers or said rotor including a recess containing a metal-filled epoxy wearable sealing material, said recess being sufficiently deep and said sealing material having a coefficient of thermal expansion sufficiently greater than the coefficient of thermal expansion of said stator end cover or said rotor so that as said rotor rotates in said stator and said rotary device heats up to its normal operating temperature, said sealing material will expand outwardly from said one of said end cover and said rotor a distance sufficient to fill the maximum possible clearance between said rotor and said end cover.

2. The device of claim 1 wherein said sealing material has a coefficient of thermal expansion of from about two to about twelve times the coefficient of thermal expansion of said material of which said one of said end cover or rotor is made.

3. The device of claim 2 in which said coefficient of thermal expansion for said sealing material is about seven times as great as the coefficient of thermal expansion of the material of which one of said end cover or rotor is made.

4. The rotary device of claim 3 in which said recess is in said end cover.

5. The rotary device of claim 1 in which said recess is in said end cover.

6. The rotary device of claim 1 in which said recess comprises an annular groove.

7. The device of claim 6 wherein said sealing material has a coefficient of thermal expansion of from about two to about twelve times the coefficient of thermal expansion of said material of which said one of said end cover or rotor is made.

8. The device of claim 6 in which said coefficient of thermal expansion for said sealing material is about seven times as great as the coefficient of thermal expansion of the material of which said one of said end cover or rotor is made.

9. The rotary device of claim 6 in which said recess is in said end cover.

10. The rotary device of claim 6 in which said recess is in said end cover.

11. A constrained rotary vane compressor, comprising:

a stator, said stator having a hollow interior and a circumferential interior wall;

at least one end cap affixed to an end of said stator;

a rotor mounted in said stator such that the axis of rotation of said rotor is parallel to but offset from the axial centerline of said stator;

said at least one end cap having a surface adjacent said rotor, said surface including material defining an annular seal groove, said seal groove having a dovetail shaped cross section and is generally circular, having a center point common with said axis of rotation of said rotor;

a plurality of vanes, said vanes slidably positioned in and extending radially from said rotor, each said vane having at least one vane lateral edge in close proximity to said at least one end cap;

means for constraining said vanes in their outward movement relative to said rotor such that the distal edges of said vanes travel in close proximity to said circumferential interior wall of said stator; and a wearable sealing material disposed within said seal groove, said seal having a coefficient of thermal expansion greater than the coefficient of thermal expansion of said end member so that said seal expands outwardly through the opening of said seal groove and into sealing engagement with said rotary member upon an increase in temperature of said end member and said seal.

12. A constrained rotary vane compressor in accordance with claim 11 wherein the coefficient of thermal expansion of said sealing material is from about two to about twelve times the coefficient of thermal expansion of the material utilized for said end cap.

13. A constrained rotary vane compressor,comprising:

a stator, said stator having a hollow interior and a circumferential interior wall;

at least one end cap affixed to an end of said stator;

a rotor mounted in said stator such that the axis of rotation of said rotor is parallel to but offset from the axial centerline of said stator;

said at least one end cap having a surface adjacent said rotor, said surface including material defining an annular seal groove;

a plurality of vanes, said vanes slidably positioned in and extending radially from said rotor, each said vane having at least one vane lateral edge in close proximity to said at least one end cap;

means for constraining said vanes in their outward movement relative to said rotor such that the distal edges of said vanes travel in close proximity to said circumferential interior wall of said stator;

a wearable sealing material disposed within said seal groove, said seal having a coefficient of thermal expansion greater than the coefficient of thermal expansion of said end member so that said seal expands outwardly through the opening of said seal groove and into sealing engagement with said rotary member upon an increase in temperature of said end member and said seal; and wherein said sealing material is a metal-filled epoxy having a coefficient of thermal expansion greater than the coefficient of thermal expansion of the material utilized for said at least one end cap.

14. A constrained rotary vane compressor, comprising:

a stator, said stator having a hollow interior and a circumferential interior wall;

at least one end cap affixed to an end of said stator;

a rotor mounted in said stator such that the axis of rotation of said rotor is parallel to but offset from the axial centerline of said stator;

said at least one end cap having a surface adjacent said rotor, said surface including material defining an annular seal groove;

a plurality of vanes, said vanes slidably positioned in and extending radially from said rotor, each said vane having at least one vane lateral edge in close proximity to said at least one end cap;

means for constraining said vanes in their outward movement relative to said rotor such that the distal edges of said vanes travel in close proximity to said circumferential interior wall of said stator;

a wearable sealing material disposed within said seal groove, said seal having a coefficient of thermal expansion greater than the coefficient of thermal expansion of said end member so that said seal expands outwardly through the opening of said seal groove and into sealing engagement with said rotary member upon an increase in temperature of said end member and said seal; and wherein said coefficient of thermal expansion of said seal is about $48\times10^{-6}$ in./in./°F.

15. A method of reducing internal leakage between regions of differing pressure in a rotary device having a rotor and a stator with end members on either side of said rotor, said method comprising:

forming a recess in at least one of said rotor and stator end members;

forming a seal from a metal-filled epoxy material having a coefficient of thermal expansion greater than the coefficient of thermal expansion of the material utilized for said one member;

positioning said seal material in said recess so that, upon an increase in temperature of said seal material, it expands outwardly from said one member toward the other, thereby reducing internal leakage between said regions of differing pressure.

16. The method of claim 15 in which said sealing material has a coefficient of thermal expansion which is two to twelve times greater than that of the material utilized for said one member.

17. The method of claim 15 in which said coefficient of thermal expansion of said sealing material is approximately seven times greater than that of said material utilized for said one member.

18. The method of claim 15 in which said recess is located in said end member.

19. The method of claim 15 in which said device is operated at normal operating temperatures for a sufficient period of time to cause said sealing material to expand and be worn down by engagement with the other of said rotor and said end member to substantially complete the wear-in of the seal to its proper operating dimensions.

20. A method of decreasing leakage between regions of differing pressure within the interior of a constrained rotary vane compressor, said compressor comprising: a stator, said stator having a hollow interior and a circumferential interior wall; at least one end cap affixed to an end of said stator; a rotor, said rotor mounted in said stator such that the axis of rotation of said rotor is parallel to but offset from the axial centerline of said stator; a plurality of vanes, said vanes slidably positioned in and extending radially from said rotor, each said vane having at least one vane lateral edge in close proximity to said at least one end cap; and a means for constraining said vanes in their outward movement relative to said rotor such that the distal edges of said vanes travel in close proximity to said circumferential interior wall of said stator; said method comprising:

forming a generally circular seal groove in at least one of said end caps, such that said seal groove has a center point common with said axis of rotation of said rotor and such that it has a dovetail shaped cross section; and depositing an amount of sealing material, having a coefficient of thermal expansion greater than said at least one end cap, in said seal groove to substantially fill said groove.

21. A method of decreasing leakage in accordance with claim 20 wherein said deposited sealing material is a metal-filled epoxy having a coefficient of thermal expansion greater than the coefficient of thermal expansion of the material utilized for said at least one end cap.

22. A method of decreasing leakage in accordance with claim 21 wherein the coefficient of thermal expansion of said deposited sealing material is from about 2 to about 12 times the coefficient of thermal expansion of the material utilized for said end cap.

23. A method of decreasing leakage in accordance with claim 20, further comprising:

operating said compressor at normal operating temperature for a sufficiently long period of time to substantially complete the wear-in of the seal to its proper operating dimensions.

* * * * *

UNITED STATES PATENT AND TRADEMARK OFFICE

CERTIFICATE OF CORRECTION

PATENT NO. : 5,452,997
DATED : September 26, 1995
INVENTORS : Frederick A. Hekman et al.

It is certified that error appears in the above-identified patent and that said Letters Patent is hereby corrected as shown below:

Column 1, Line 36:

"time" should be --the--.

Signed and Sealed this

Thirtieth Day of April, 1996

*Attest:*

*Attesting Officer*

BRUCE LEHMAN

*Commissioner of Patents and Trademarks*